US008802611B2

(12) United States Patent
Miralles

(10) Patent No.: US 8,802,611 B2
(45) Date of Patent: Aug. 12, 2014

(54) HIGHLY CONCENTRATED CAUSTIC BLOCK FOR WARE WASHING

(75) Inventor: Altony Miralles, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 372 days.

(21) Appl. No.: 12/772,402

(22) Filed: May 3, 2010

(65) Prior Publication Data

US 2011/0269662 A1 Nov. 3, 2011

(51) Int. Cl.

| | |
|---|---|
| ***C11D 3/39*** | (2006.01) |
| ***C11D 17/00*** | (2006.01) |
| ***B08B 9/20*** | (2006.01) |
| ***B08B 3/00*** | (2006.01) |

(52) U.S. Cl.
USPC ..... 510/220; 510/225; 314/25.2; 314/95.1

(58) Field of Classification Search
USPC ..... 510/220, 225; 134/25.2, 95.1
See application file for complete search history.

(56) References Cited

U.S. PATENT DOCUMENTS

| | | | | |
|---|---|---|---|---|
| 3,923,856 | A * | 12/1975 | Danzik et al. | 558/32 |
| 4,569,780 | A | 2/1986 | Fernholz et al. | |
| 4,569,781 | A | 2/1986 | Fernholz et al. | |
| 4,595,520 | A | 6/1986 | Heile et al. | |
| 4,618,914 | A | 10/1986 | Sato et al. | |
| 4,725,376 | A | 2/1988 | Copeland | |
| 4,830,773 | A | 5/1989 | Olson | |
| 4,846,989 | A | 7/1989 | Killa | |
| 4,846,993 | A | 7/1989 | Lentsch et al. | |
| 5,340,501 | A | 8/1994 | Steindorf | |
| 5,474,698 | A | 12/1995 | Rolando et al. | |
| 5,482,641 | A | 1/1996 | Fleisher | |
| 5,552,079 | A | 9/1996 | Roach et al. | |
| 5,665,694 | A * | 9/1997 | Backes et al. | 510/480 |
| 5,719,111 | A * | 2/1998 | van den Brom et al. | 510/224 |
| 5,759,976 | A | 6/1998 | Roach et al. | |
| 5,759,977 | A | 6/1998 | Van Den Brom et al. | |
| 5,759,988 | A | 6/1998 | Heile et al. | |
| 5,981,457 | A | 11/1999 | Ahmed | |
| 6,017,864 | A | 1/2000 | Brittain et al. | |
| 6,124,250 | A | 9/2000 | Olson et al. | |
| 6,463,939 | B1 | 10/2002 | Kornaat et al. | |
| 6,632,291 | B2 * | 10/2003 | Rabon et al. | 134/26 |
| 6,660,707 | B2 | 12/2003 | Lentsch et al. | |
| 7,341,983 | B2 | 3/2008 | Penderson et al. | |
| 7,524,803 | B2 | 4/2009 | Lentsch et al. | |
| 7,828,907 | B2 * | 11/2010 | Miralles et al. | 134/26 |
| 7,902,173 | B2 * | 3/2011 | Yoshida et al. | 514/57 |
| 2002/0065205 | A1 * | 5/2002 | Maria Neplenbroek et al. | 510/220 |
| 2005/0003979 | A1 | 1/2005 | Lentsch et al. | |
| 2005/0020464 | A1 | 1/2005 | Smith et al. | |
| 2008/0274930 | A1 | 11/2008 | Smith et al. | |
| 2008/0276973 | A1 | 11/2008 | Miralles et al. | |
| 2009/0131297 | A1 | 5/2009 | Smith et al. | |
| 2009/0199874 | A1 * | 8/2009 | Fletcher et al. | 134/25.2 |

FOREIGN PATENT DOCUMENTS

KR 1020080032843 A 4/2008

OTHER PUBLICATIONS

International Search Report and Written Opinion for PCT/IB2011/051910, Feb. 24, 2012.

* cited by examiner

*Primary Examiner* — Ling Choi
*Assistant Examiner* — Thuy-Ai Nguyen
(74) *Attorney, Agent, or Firm* — Amy J. Hoffman

(57) ABSTRACT

A system for cleaning ware includes a detergent composition and a rinse solution. The detergent composition includes an alkali metal hydroxide, a corrosion inhibitor and a surfactant. The detergent includes less than about 1% of an alkali metal carbonate by weight. The rinse solution includes water and a chelating acid.

13 Claims, No Drawings

HIGHLY CONCENTRATED CAUSTIC BLOCK FOR WARE WASHING

TECHNICAL FIELD

The present invention is related generally to the field of detergent systems. In particular, the present invention is a detergent system including a caustic detergent and an acidic rinse solution.

BACKGROUND

Most current cast warewashing detergents contain a combination of caustic and carbonate. Carbonate has conventionally been included in detergents to provide alkalinity and some buffer capacity. However, the presence of carbonates can exacerbate the tendency of hard water to precipitate and scale.

Conventional detergents also commonly include phosphorus-containing materials or builders. Phosphates are multifunctional components commonly used in detergents to reduce water hardness as well as increase detergency, antiredeposition, and crystal modification. In particular, polyphosphates such as sodium tripolyphosphate and their salts are used in detergents because of their ability to prevent calcium carbonate precipitation and their ability to disperse and suspend soils. If calcium carbonates are allowed to precipitate, the crystals may attach to the surface being cleaned and may cause undesirable effects. For example, calcium carbonate precipitation on the surface of ware can negatively impact the aesthetic appearance of the ware and give the ware an unclean look. The ability of sodium tripolyphosphate to disperse and suspend soils facilitates the detergency of the solution by preventing the soils from redepositing into the wash solution or wash water. However, while effective, phosphates are subject to government regulations due to environmental and health concerns.

SUMMARY

In one embodiment, the present invention is a system for cleaning ware. The system includes a detergent composition and a rinse solution. The detergent composition includes an alkali metal hydroxide, and may further include a corrosion inhibitor and a surfactant. In one embodiment, the detergent composition is also substantially free of alkali metal carbonates. The rinse solution includes water and a chelating acid.

In another embodiment, the present invention is a cleaning system for removing soils from a surface and preventing precipitation of water hardness. The cleaning system includes a caustic detergent and a rinse solution. The caustic detergent includes at least about 80% by weight alkali metal hydroxide, and may further contain up to about 10% by weight corrosion inhibitor and up to about 10% by weight surfactant. The rinse solution includes water and a chelating acid.

In yet another embodiment, the present invention is a method of removing soils from a surface. The method includes contacting the surface with a detergent composition and subsequently rinsing the surface with a rinse solution. The detergent composition includes an alkali metal hydroxide, a corrosion inhibitor and a surfactant. The rinse solution includes water and a chelating acid.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Cleaning System

The present invention relates to cleaning systems and methods of removing soils from a surface and preventing deposition of water hardness onto the surface. In particular, the cleaning system is effective at removing soils from hard surfaces, such as ware. The cleaning system includes a caustic detergent and an acidic rinse solution. In one embodiment, the caustic detergent is substantially free of phosphorus-containing compounds. Thus, the cleaning system provides a green, readily biodegradeable replacement for conventional detergents. The cleaning system can be used in various industries, including, but not limited to: automatic warewashing, food and beverage, vehicle care, health care, quick service restaurants and textile care. In particular, the cleaning system can be used in hard-surface cleaning applications, including, for example: ware, bathroom surfaces, dishwashing equipment, food and beverage equipment, health care instruments, vehicles and tabletops. The cleaning system can also be used in laundering applications.

Because carbonate salts generally do not significantly contribute to the alkalinity of a composition, the alkalinity of the composition does not require carbonates salts. In fact, a reduction in the amount of carbonate salts in a composition can be desirable. For example, when a dishmachine is filled or when more detergent, which is generally caustic, is added to a dishmachine after rinsing, the hard water is exposed to the caustic detergent and forms $CaCO_3$ that will precipitate almost immediately due to the high temperature in the dishmachine. Thus, in one embodiment, the cleaning system of the present invention is substantially free of alkali metal carbonates and uses only caustic as an alkalinity source and builder. Alkali metal carbonate-free refers to a composition, mixture, or ingredients to which alkali metal carbonates are not added. In another embodiment, the level of alkali metal carbonates in the resulting composition is less than approximately 10 wt %. In a further embodiment the level of metal alkali is less than 1 wt %, more particularly less than approximately 0.5 wt %, less than 0.1 wt %, and often less than 0.01 wt %.

In one embodiment, the cleaning system of the present invention is substantially phosphorus-free. In another embodiment, the composition is less than 0.5 wt %, particularly less than 0.1 wt %, and more particularly less than approximately 0.01 wt % phosphorous.

In one embodiment, the cleaning system of the present invention is substantially free of hard water controlling agents. Should hard water controlling agents be present through contamination, the level of hard water controlling agent in the resulting composition is less than approximately 0.5 wt %, less than approximately 0.1 wt %, and often less than approximately 0.01 wt %.

Caustic Detergent

The caustic detergent includes an alkali metal hydroxide, and may further include a corrosion inhibitor and a surfactant. The alkali metal hydroxide provides cleaning properties to the caustic system and functions as an alkalinity source and builder. The alkali metal hydroxide is also used to control the pH of the resulting solution when water is added to the caustic detergent to form a use solution. The pH of the use solution must be maintained in the alkaline range in order to provide sufficient detergency properties. In one embodiment, the pH of the use solution is between approximately 9 and approximately 13. In particular, the pH of the use solution is between approximately 10 and approximately 12. More particularly, the pH of the use solution is between approximately 10.5 and approximately 11.5. The alkali metal hydroxide is added to the caustic detergent in liquid form and/or solid form. Both liquid and solid forms may be present in order to have a partially hydrated alkali metal hydroxide. Using a partially hydrated alkali metal hydroxide diminishes the generation of steam from the heat of hydration during dispensing. In one embodiment, the alkali metal hydroxide is added in liquid form and in bead form. Examples of suitable alkali metal hydroxides include, but are not limited to: sodium hydroxide, potassium hydroxide and rubidium hydroxide. A particularly suitable alkali metal hydroxide includes, but is not limited to, sodium hydroxide.

Corrosion inhibitor may be included in the caustic detergent in an amount sufficient to provide a use solution that decreases the rate of corrosion and/or etching of glass a surface being contacted by the caustic detergent. Examples of suitable corrosion inhibitors include, but are not limited to: a combination of a source of a lithium ion, a source of an aluminum ion, an alkali metal silicate or hydrate thereof and combinations thereof. Particularly suitable corrosion inhibitors include, but are not limited to, sodium aluminate, lithium hydroxide, metal silicates and combinations thereof.

In one embodiment, the corrosion inhibitor includes at least a soluble lithium salt. The soluble lithium salt provides lithium ions when the warewashing composition is provided in the form of a use solution. The soluble lithium salt can be provided as an organic salt, inorganic salt or mixtures thereof. Exemplary sources of soluble lithium salts include, but are not limited to: lithium hydroxide, lithium silicate, lithium metasilicate, lithium chloride, lithium sulfate, lithium nitrate, lithium iodide, lithium thiocyanate, lithium dichromate, lithium chlorate, lithium gluconate, lithium acetate, lithium benzoate, lithium citrate, lithium lactate, lithium formate, lithium bromate, lithium bromide, lithium fluoride, lithium fluorosilicate and lithium salicylate.

In another embodiment, the corrosion inhibitor includes a soluble lithium salt and a soluble aluminum salt and/or a soluble silicate ($SiO_2$) salt. The soluble aluminum salt and soluble silicate salt provide aluminum ions and silicate ions, respectively, when the warewashing composition is provided in the form of a use solution. The soluble aluminum salt can be provided as an organic salt, inorganic salt or mixtures thereof. Exemplary soluble aluminum salts include, but are not limited to: sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum bromate, aluminum borate, aluminum potassium sulfate, aluminum zinc sulphate, aluminum phosphate and aluminum lithium sulfate. The soluble silicate salt can be provided as a soluble inorganic salt. Exemplary soluble silicate salts include, but not limited to: lithium silicate, lithium metasilicate, sodium metasilicate, potassium metasilicate, sodium orthosilicate, and potassium orthosilicate.

The caustic detergent may also include a surfactant. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference. Examples of surfactants that can be used in the caustic detergent includes ethylene oxide/propylene block copolymers such as those available under the name Pluronic N3, Pluronic 17R2, Pluronic 31R1, Pluronic L10, Pluronic L31, Pluronic L61, Pluronic L62 and D500, available from BASF Corporation, Florham Park, N.J.

Suitable component concentrations for the caustic detergent range from at least approximately 80% by weight alkali metal hydroxide, up to about 10% by weight corrosion inhibitor and up to about 10% by weight surfactant component. Particularly suitable component concentrations for the caustic detergent range from between about 90% and about 99% by weight alkali metal hydroxide, between about 0.5% and about 8% by weight corrosion inhibitor and between about 0.5% and about 8% by weight surfactant component. More particularly suitable component concentrations for the caustic detergent range from between about 92% and about 98% by weight alkali metal hydroxide, between about 1% and about 5% by weight corrosion inhibitor and between about 1% and about 5% by weight surfactant component. Those skilled in the art will appreciate other suitable component concentration ranges for obtaining comparable properties of the solidification matrix.

Rinse Solution

The rinse solution includes a chelating acid and water. In one embodiment, if the water used is deionized water, the chelating acid is optional. The amount or concentration of the chelating acid will depend on a number of parameters, including, but not limited to: the pH of the rinse solution, the acidity of the acid, the chelating properties of the acid and the volume of water/unit of time the rinse solution is in contact with the surface being cleaned. Examples of suitable chelating acids include, but are not limited to, citric acid, gluconic acid, tartaric acid, lactic acid, maleic acid, malic acid, glucaric acid, N-mono and diacetate amino acid, picolinic acid, oxalic acid, 3,4-dihydroxybenzoic acid, fumaric acid, glucoheptonic acid, nitrilotriacetic acid, and ethylenediaminetetraacetic acid, Examples of particularly suitable chelating acids include citric acid, gluconic acid, tartaric acid, lactic acid and maleic acid. Citric acid is particularly suitable for environmentally friendly cleaning systems because it is classified as a GRAS (generally recognized as safe) by the United States Food and Drug Administration.

Additional Functional Materials

The cleaning system can include additional components or agents, such as additional functional materials. As such, in some embodiments, the caustic detergent including the alkalinity source, corrosion inhibitor and surfactant component may provide a large amount, or even all of the total weight of the caustic detergent, for example, in embodiments having few or no additional functional materials disposed therein. Likewise, in some embodiments, the rinse solution including water and the chelating acid may provide a large amount or even all of the total weight of the rinse solution, for example, in embodiments having few or no additional functional materials disposed therein. The functional materials provide desired properties and functionalities to the cleaning system. For the purpose of this application, the term "functional materials" includes a material that when dispersed or dissolved in a use and/or concentrate solution, such as an aqueous solution, provides a beneficial property in a particular use. The cleaning system may optionally contain other soil-digesting components, surfactants, disinfectants, oxidants, sanitizers, acidulants, complexing agents, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Surfactants

The cleaning system can contain an anionic surfactant component that includes a detersive amount of an anionic surfactant or a mixture of anionic surfactants. Anionic surfactants are desirable in cleaning systems because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning system can have an alkyl group that contains 6 to 24 carbon atoms and the aryl group can be at least one of benzene, toluene, and xylene. An suitable alkyl aryl sulfonate includes linear alkyl benzene sulfonate. An suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning system can have an alkane group having 6 to 24 carbon atoms. Suitable alkane sulfonates that can be used include secondary alkane sulfonates. An suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning system include those having an alkyl group containing 6 to 24 carbon atoms. Suitable alpha olefin sulfonates that can be used in the cleaning system include those having alpha olefin groups containing 6 to 24 carbon atoms.

Suitable alkyl ether sulfates that can be used in the cleaning system include those having between about 1 and about 10 repeating alkoxy groups, between about 1 and about 5 repeating alkoxy groups. In general, the alkoxy group will contain between about 2 and about 4 carbon atoms. An suitable alkoxy group is ethoxy. An suitable alkyl ether sulfate is sodium lauric ether ethoxylate sulfate and is available under the name Steol CS-460.

Suitable alkyl sulfates that can be used in the cleaning system include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning system include those having an alcohol group containing about 6 to about 24 carbon atoms.

The anionic surfactant can be neutralized with an alkali metal salt, an amine, or a mixture thereof. Suitable alkali metal salts include sodium, potassium, and magnesium. Suitable amines include monoethanolamine, triethanolamine, and monoisopropanolamine. If a mixture of salts is used, a suitable mixture of alkali metal salt can be sodium and magnesium, and the molar ratio of sodium to magnesium can be between about 3:1 and about 1:1.

The cleaning system, when provided as a concentrate, can include the anionic surfactant component in an amount sufficient to provide a use composition having desired wetting and detersive properties after dilution with water. The concentrate can contain about 0.1 wt % to about 0.5 wt %, about 0.1 wt % to about 1.0 wt %, about 1.0 wt % to about 5 wt %, about 5 wt % to about 10 wt %, about 10 wt % to about 20 wt %, about 20 wt % to about 30 wt %, about 0.5 wt % to about 25 wt %, and about 1 wt % to about 15 wt %, and similar intermediate concentrations of the anionic surfactant.

The cleaning system can contain a nonionic surfactant component that includes a detersive amount of nonionic surfactant or a mixture of nonionic surfactants. Nonionic surfactants can be included in the caustic detergent to enhance grease removal properties. Although the surfactant component can include a nonionic surfactant component, it should be understood that the nonionic surfactant component can be excluded from the cleaning system.

Nonionic surfactants that can be used in the cleaning system include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Additional nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauramide diethanolamide, cocoamide diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the cleaning system, they can be included in an amount of at least about 0.1 wt % and can be included in an amount of up to about 15 wt %. The concentrate can include about 0.1 to 1.0 wt %, about 0.5 wt % to about 12 wt % or about 2 wt % to about 10 wt % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphrodipropionates, aminopropionates, aminodipropionates, amphoacetates, amphodiacetates, and amphohydroxypropylsulfonates.

When the cleaning system includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning system can contain a cationic surfactant component that includes a detersive amount of cationic surfactant or a mixture of cationic surfactants. The cationic surfactant can be used to provide sanitizing properties.

Cationic surfactants that can be used in the cleaning system include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl ($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Thickening Agents

The viscosity of the caustic detergent increases with the amount of thickening agent, and viscous compositions are useful for uses where the cleaning system clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylate polymers and copolymers; and hydrocolloid thickeners, such as pectin. Generally, the concentration of thickener employed in the present cleaning systems or methods will be dictated by the desired viscosity within the final composition. However, as a general guideline, the viscosity of thickener within the present cleaning system ranges from about 0.1 wt % to about 3 wt %, from about 0.1 wt % to about 2 wt %, or about 0.1 wt % to about 0.5 wt %.

Bleaching Agents

The cleaning system may also include bleaching agents for lightening or whitening a substrate. Examples of suitable bleaching agents include bleaching compounds capable of liberating an active halogen species, such as $Cl_2$, $Br_2$, —$OCL^-$ and/or —$OBr^-$, under conditions typically encountered during the cleansing process. Suitable bleaching agents for use in the present cleaning systems include, for example, chlorine-containing compounds such as a chlorine, a hypochlorite and chloramine. Exemplary halogen-releasing compounds include the alkali metal dichloroisocyanurates, chlorinated trisodium phosphate, the alkali metal hypochlorites, monochloramine and dichloramine and the like. Encapsulated chlorine sources may also be used to enhance the stability of the chlorine source in the cleaning systems (see, for example, U.S. Pat. Nos. 4,618,914 and 4,830,773, the disclosures of which are incorporated by reference herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine and the like. The cleaning system can include an effective amount of a bleaching agent. When the concentrate includes a bleaching agent, it can be included in an amount of about 0.1 wt. % to about 60 wt. %, about 1 wt. % to about 20 wt. %, about 3 wt. % to about 8 wt. %, and about 3 wt. % to about 6 wt. %.

Detergent Fillers

The cleaning system can include an effective amount of detergent fillers, which does not perform as a cleaning agent per se, but cooperates with the cleaning agent to enhance the overall cleaning capacity of the cleaning systems. Examples of detergent fillers suitable for use in the present cleaning systems include sodium sulfate, sodium chloride, starch, sugars, $C_1$-$C_{10}$ alkylene glycols such as propylene glycol and the like. When the concentrate includes a detergent filler, it can be included in an amount of between about 1 wt % and about 20 wt % and between about 3 wt % and about 15 wt %.

Antiredeposition Agents

The cleaning system can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose and the like. When the concentrate includes an anti-redeposition agent, the anti-redeposition agent can be included in an amount of between about 0.5 wt % and about 10 wt % and between about 1 wt % and about 5 wt %.

Stabilizing Agents

Stabilizing agents that can be used in the cleaning system include, but are not limited to: primary aliphatic amines, betaines, borate, calcium ions, sodium citrate, citric acid, sodium formate, glycerine, maleonic acid, organic diacids, polyols, propylene glycol and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20 wt %, between about 0.5 wt % to about 15 wt % and between about 2 wt % to about 10 wt %.

Dispersants

Dispersants that can be used in the cleaning system include maleic acid/olefin copolymers, polyacrylic acid, and its copolymers and mixtures thereof. The concentrate need not include a dispersant, but when a dispersant is included it can be included in an amount that provides the desired dispersant properties. Exemplary ranges of the dispersant in the concentrate can be up to about 20 wt. %, between about 0.5 w. % and about 15 wt %, and between about 2 wt % and about 9 wt %.

Dyes and Fragrances

Various dyes, odorants including perfumes, and other aesthetic enhancing agents may also be included in the cleaning system. Dyes may be included to alter the appearance of the cleaning system, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam) and the like.

Fragrances or perfumes that may be included in the cleaning system include, for example, terpenoids such as citronellol, aldehydes such as amyl cinnamaldehyde, a jasmine such as C1S-jasmine or jasmal, vanillin and the like.

Adjuvants

The cleaning system can also include any number of adjuvants. Specifically, the cleaning system can include stabilizing agents, wetting agents, thickeners, foaming agents, corrosion inhibitors, biocides, hydrogen peroxide, pigments or dyes among any number of other constituents which can be added to the cleaning system. Such adjuvants can be preformulated with the present cleaning system or added to the cleaning system simultaneously, or even after, the addition of the present cleaning system. The cleaning system can also contain any number of other constituents as necessitated by the application, which are known and which can facilitate the activity of the present cleaning systems.

Embodiments of the Present Cleaning System

The caustic detergent of the present invention is effective at removing soils and preventing redeposition. Several suitable exemplary concentrate compositions are provided in the following table.

TABLE 1

| Exemplary Composition | | | |
|---|---|---|---|
| Component | Range 1 (Wt %) | Range 2 (Wt %) | Range 3 (Wt %) |
| Caustic | 70-100 | 90-99 | 92-98 |
| Surfactant | 0-10 | 0.5-8 | 1-5 |
| Corrosion Inhibitor | 0-10 | 0.5-8 | 1-5 |

A caustic detergent use concentration of 446.5 parts per million (ppm) will yield about 220 ppm of caustic soda, a caustic detergent use concentration of 458.5 parts per million (ppm) will yield about 330 ppm of caustic soda and a caustic detergent use concentration of about 500 ppm will yield about 360 ppm of caustic soda.

The concentrate caustic detergent of the present invention can be provided as a solid, liquid, or gel, or a combination thereof. In one embodiment, the caustic detergent may be provided as a concentrate such that the caustic detergent is substantially free of any added water or the concentrate may contain a nominal amount of water. The concentrate can be formulated without any water or can be provided with a relatively small amount of water in order to reduce the expense of transporting the concentrate. For example, the caustic detergent concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the caustic detergent concentrate with the water. For the purposes of this disclosure, the terms "capsule" and "pellet" are used for exemplary purposes and are not intended to limit the delivery mode of the invention to a particular shape.

When provided as a liquid concentrate, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate can be provided in a solid form that resists crumbling or other degradation until placed into a container. Such container may either be filled with water before placing the composition concentrate into the container, or it may be filled with water after the concentrate is placed into the container. In either case, the solid concentrate caustic detergent dissolves, solubilizes, or otherwise disintegrates upon contact with water. In a particular embodiment, the solid concentrate caustic detergent dissolves rapidly thereby allowing the concentrate to become a use composition and further allowing the end user to apply the use composition to a surface in need of cleaning. When the caustic detergent is provided as a solid, the compositions provided above in Table 1 may be altered in a manner to solidify the cleaning composition by any means known in the art. For example, the amount of water may be reduced or additional ingredients may be added to the caustic detergent, such as a solidification agent.

In another embodiment, the solid concentrate can be diluted through dispensing equipment whereby water is sprayed at the solid block forming the use solution. The water flow is delivered at a relatively constant rate using mechanical, electrical, or hydraulic controls and the like. The solid concentrate can also be diluted through dispensing equipment whereby water flows around the solid block, creating a use solution as the solid concentrate dissolves. The solid concentrate can also be diluted through pellet, tablet, powder and paste dispensers, and the like.

The water used to dilute the concentrate (water of dilution) can be available at the locale or site of dilution. The water of dilution may contain varying levels of hardness depending upon the locale. Service water available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 GPG (grains per gallon) hardness, at least 10 GPG hardness, or at least 20 GPG hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty cleaning use solution is desired, it is expected that the concentrate can be diluted at a weight ratio of concentrate to water of dilution of up to about 1:1000.

In an alternate embodiment, the caustic detergent may be provided as a ready-to-use (RTU) composition. If the caustic detergent is provided as a RTU composition, a more significant amount of water is added to the caustic detergent as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. In the case of a liquid concentrate, it is expected that water will be present in an amount of up to about 90 wt %, particularly between about 20 wt % and about 85 wt %, more particularly between about 30 wt % and about 80 wt. % and most particularly between about 50 wt % and about 80 wt %.

In the case of a RTU composition, it should be noted that the above-disclosed cleaning composition may, if desired, be further diluted with up to about 96 wt % water, based on the weight of the caustic detergent.

The rinse solution of the present invention is effective at preventing calcium carbonate precipitation. The concentration of the chelating acid in the rinse solution will depend on a number of parameters, including: the pH of the rinse solution, the acidity of the acid, the chelating properties of the acid and the volume of water/unit of time the rinse solution is on contact with the surface. In one embodiment, the rinse solution includes about 2 milliliters (mL) of 50% chelating acid per 4.5 liters of water.

The cleaning system of the present invention may be useful to clean a variety of surfaces. The cleaning system may be used to clean soils on hard surfaces including, but not limited to: ceramics, ceramic tile, grout, granite, concrete, mirrors, enameled surfaces, metals including aluminum, brass, stainless steel and the like. The cleaning system may also be used to clean soiled linens such as towels, sheets, and nonwoven webs. As such, the cleaning system of the present invention are useful to formulate hard surface cleaners, laundry detergents, oven cleaners, automotive detergents, and warewashing detergents.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Test Methods

Two different dishmachines were used in the following examples, the Hobart Dish Machine AM14 and the Hobart Dish Machine AM15. The dishmachines function similarly except for the amount of water used in the rinse cycles. The Hobart Dish Machine AM14 used 4.5 liters (1.19 gallons) per rinse while the Hobart Dish Machine AM15 used 2.8 liters (0.74 gallons) per rinse.

Multi-Cycle Spot, Film and Soil Removal

A generic method for evaluating glass filming, spotting and soil removal in an institutional dishmachine was performed. Clean test glasses were first washed in the Hobart Dish Machine AM14 and the Hobart Dish Machine AM15. The performance of the caustic detergent was measured by the ability of the caustic detergent to prevent water spotting or filming and to remove soil from plastic tumblers and Libby Glass tumblers.

A food soil was prepared using a 50/50 combination of beef stew and hot point soil at 2000 ppm. The soil consisted of two cans of Dinty Moore Beef Stew, a large can of tomato sauce, 15.5 sticks of Blue Bonnet Margarine and powdered milk.

The dishmachines were filled with water and the heaters were turned on. The final rinse temperature was adjusted to about 180 degrees Fahrenheit (° F.). The glasses and plastic tumblers were soiled by rolling them three times in a 1:1 (v/v) mixture of Campbell's Cream of Chicken Soup:Kemp's Whole Milk. The glasses were then placed in an oven heated to temperature of about 160° F. for about 8 minutes. While the glasses were drying, the warewash machine was primed with about 120 grams of the food soil. This corresponded to about 2000 ppm of food soil in the sump.

The glasses and plastic tumblers were then placed in a rack beside glasses and plastic tumblers to be tested for redeposition in the following arrangement. The first two rows were tested for soil removal while the second two rows were tested for redeposition. A "P" corresponds to a plastic tumbler and a "G" corresponds to a glass tumbler.

| | | | |
|---|---|---|---|
| | G | G | |
| | G | G | |
| P | G | G | P |
| P | G | G | P |
| | G | G | |
| | G | G | |

The glasses and plastic tumblers were then run through an automatic cycle. When the cycle ended, the top of the glasses were mopped with a dry towel. The glasses that were previously rolled in the soup/milk mixture were removed and the resoiled. The redeposition glasses were not removed.

At the beginning of each cycle, the appropriate amount of detergent and food soil were added to the wash tank to make up for the rinse dilution. This cycle was repeated seven times. The glasses were then allowed to dry overnight, and ½ of the glass were stained with Commassie Blue and destained to identify protein residues.

To prepare the Commassie Blue stain, about 1.25 grams of Commassie Blue R was combined with about 45 mL of acetic acid and about 455 mL of 50% methanol in distilled water. The glasses and plastic tumblers were dipped into the dye and rinsed with destaining solution. Protein residue stained blue. The destaining solution was about 45% methanol and 10% acetic acid in distilled water. The glasses were rated visually against a white background once stained with Commassie Blue and dried overnight.

The other ½ of the glasses were stained with Sudan IV to identify fats and oils. To prepare Sudan IV stain, about 0.1 grams of Sudan IV into about 50 mL of acetone. About 35 mL of 100% ethanol and about 15 mL of distilled water was added. The solution was filtered using Watman #1 or #2 filter paper. The glass was dipped into the dye and was allowed to stand for about one minute. The glasses were then destained with a 35% ethanol solution and rinsed with distilled water. Any fats and oils stained red.

100-Cycle Film Evaluation for Institutional Warewash Detergents

A generic method for evaluating glass and plastic film accumulation in an institutional warewash machine was performed. Test glasses were washed in the Hobart Dish Machine AM14 and the Hobart Dish Machine AM15 with a predetermined concentration of detergent. All of the glasses are left untreated and examined for film accumulation. Six glasses were first cleaned and the dishmachine was filled with appropriate water. The water was tested for hardness and the value recorded. The tank heaters were then turned on.

The dishmachines were turned on and wash and rinse cycles were run through the dishmachines until a wash temperature of about 150 to about 160° F. and a rinse temperature of about 175 to about 190° F. was reached. The controller was then set to dispense the appropriate amount of detergent into the wash tank Six clean glasses were placed diagonally and one plastic tumbler was placed off-diagonally in a Raburn rack in the arrangement below. A "P" corresponds to a plastic tumbler and a "G" corresponds to a glass tumbler.

| | | | | | |
|---|---|---|---|---|---|
| | | | | | G |
| | | | | G | |
| | | | G | | |
| | | G | | | |
| | G | | | P | |
| G | | | | | |

The 100-cycle test was then started. At the beginning of each wash cycle, the appropriate amount of detergent was automatically dispensed into the dishmachine to maintain the initial detergent concentration. The detergent concentration was controlled by conductivity.

The glasses and plastic tumbler were allowed to dry overnight and evaluated for film accumulation using a strong light source.

Example 1

Caustic Detergent+Deionized Water

To first test the theory that it is the hard water in the rinse solution that causes precipitation of calcium onto the surface of ware, a cleaning system using a caustic detergent and a rinse solution including only deionized water was tested according to the 100-Cycle Film Evaluation method described above. The caustic detergent composition was formulated with component concentrations of sodium hydroxide, sodium aluminate, lithium hydroxide and a surfactant as listed in Table 2.

TABLE 2

| Component | Weight (g) |
|---|---|
| NaOH (50%) liquid | 47.98 |
| NaOH, beads | 47.98 |
| Sodium Aluminate | 0.46 |
| Lithium Hydroxide | 0.96 |
| Pluronic N3 | 2.62 |

Table 3 provides the rinse solution, the concentrations of detergent and sodium hydroxide, the number of wash cycles, the water hardness, the machine in which the runs were carried out and the appearance of the glasses and plastic after being washed with the cleaning system.

TABLE 3

| Rinse Solution | Detergent Conc. (ppm) | NaOH Conc. (ppm) | Cycles | Water Hardness (GPG) | Machine | Appearance |
|---|---|---|---|---|---|---|
| Deionized Water | 458.5 | 330 | 25 | 19 | AM14 | Clear; No scaling on machine |

The results in Table 3 illustrate that when deionized water is used in the rinse solution, no calcium precipitation is formed on the surfaces of the ware washed with the cleaning system. Thus, any spotting or filming on the surface of ware is caused by the hard water generally used during the rinse cycle of a warewashing operation.

Example 2

Milk Soil

To test that the caustic detergent provided in Table 2 had sufficient ability to remove soil and prevent redeposition of soil onto clean glasses, the glasses and plastic tumbler were soiled with milk and then subject to the Multi-Cycle Spot, Film and Soil Removal method described above. The glasses and plastic tumbler were cleaned using the caustic detergent described in Table 2. There were no intermediate rinsing steps. At the end of 10 cycles, the glasses and plastic tumbler were rinsed with deionized water. To evaluate soil removal from the ware, the glasses and plastic tumbler were stained with Commasie Blue and Sudan IV to check for protein and fat deposition on the surface of the ware.

Table 4 provides the number of wash cycles, the water hardness, the machine in which the runs were carried out, the appearance of the glasses and plastic after being washed with the caustic detergent, the amount of redeposition on the glasses and plastic tumbler and any Commasie Blue or Sudan IV staining.

TABLE 4

| Rinse Solution | Cycles | Water Hardness (GPG) | Machine | Appearance | Redeposition | Commasie Blue | Sudan IV |
|---|---|---|---|---|---|---|---|
| Deionized water | 10 | 5 | AM14 | Clear | Clear | Clear | Clear |

As can be seen by the results in Table 4, when the glasses and plastic tumbler were washed with a caustic detergent of the present invention, there were no fat or protein deposits on the surfaces of the glasses and plastic tumbler. In addition, the glass and plastic surfaces tested for redeposition were clear.

Example 3

Caustic Detergent+2 mL/Rinse 50% Gluconic Acid

After it was determined that a cleaning system using a highly caustic detergent and deionized water resulted in clear glass and plastic surfaces, a chelating acid was added to hard water for use as the rinse solution. The chelating acid was added to the rinse water to test precipitation of water hardness could be prevented during the rinsing steps due to the residual alkalinity left on the surface of the glasses and plastic tumbler by the caustic detergent. To test the ability of various cleaning systems to remove protein from glass and plastic surfaces according to the 100-Cycle Film Evaluation method described above, a caustic detergent composition was first formulated with component concentrations of sodium hydroxide, sodium aluminate and lithium hydroxide as listed in Table 5.

TABLE 5

| Component | Weight (g) |
|---|---|
| NaOH (50%) liquid | 54.18 |
| NaOH, beads | 44.42 |
| Sodium Aluminate | 0.46 |
| Lithium Hydroxide | 0.95 |

The caustic detergent was used in combination with a hard water rinse and in combination with an aqueous rinse solution including 50% by weight gluconic acid. Table 6 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 6

| Rinse Solution | Detergent Conc. (ppm) | NaOH Conc. (ppm) | Cycles | Water Hardness (GPG) | Machine | Appearance |
|---|---|---|---|---|---|---|
| 18 GPG Water | 446.5 | 220 | 26 | 18 | AM15 | Glasses frosted/Plastic spotted |
| 50% Gluconic Acid: 3.6 mL/rinse first 12 cycles, 8.5 mL/rinse | 446.5 | 220 | 50 | 18 | AM15 | Clear |

As can be seen from the results in Table 6, the cleaning system that included the gluconic acid rinse resulted in clear glass and plastic surfaces while the cleaning system that included a hard water rinse resulted in frosted glass and spotted plastic. This was true even though the glasses and plastic tumbler that were washed by the cleaning system including the gluconic acid rinse underwent almost twice as many wash cycles as the glasses and plastic tumbler that were washed by the cleaning system that used a hard water rinse.

Example 4

Caustic Detergent+Various Concentrations of Gluconic Acid Rinse Solutions

Another caustic detergent composition was then formulated with component concentrations of sodium hydroxide, sodium aluminate, lithium hydroxide and a surfactant as listed in Table 7.

TABLE 7

| Component | Weight (g) |
|---|---|
| NaOH (50%) liquid | 47.98 |
| NaOH, beads | 47.98 |

TABLE 7-continued

| Component | Weight (g) |
|---|---|
| Sodium Aluminate | 0.46 |
| Lithium Hydroxide | 0.96 |
| Pluronic N3 | 2.62 |

All of the following cleaning systems were tested used the caustic detergent listed in Table 7 and included varying concentrations of gluconic acid. A rinse solution including 50% gluconic acid was used in two cleaning systems, with one cleaning system using 0.97 mL/rinse and another cleaning system using 2.04 mL/rinse. A rinse solution including 9% gluconic acid was used in two cleaning systems, with one cleaning system using 1 mL/rinse and the other cleaning system using 3 mL/rinse. Table 8 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 8

| Rinse Solution | Detergent Conc. (ppm) | NaOH Conc. (ppm) | Cycles | Water Hardness (GPG) | Machine | Appearance |
|---|---|---|---|---|---|---|
| 50% Gluconic Acid: 0.97 mL/rinse | 489.5 | 358.8 | 25 | 18 | AM14 | Glasses frosted/Plastic spotted |
| 50% Gluconic Acid: 2.04 mL/rinse | 489.5 | 358.8 | 25 | 18 | AM14 | Glasses frosted/Plastic spotted |
| 9% Gluconic Acid: 1 mL/rinse | 458.5 | 330 | 25 | 15.5 | AM15 | Glasses very frosted/Plastic very spotted with film |
| 9% Gluconic Acid: 3 mL/rinse | 458.5 | 330 | 25 | 15.5 | AM15 | Glasses very frosted/Plastic slightly spotted |

Table 8 illustrates the effect that the concentration of the chelating acid in the rinse solution has on preventing calcium precipitation onto glass and plastic surfaces. At 1 mL/rinse and 2 mL/rinse concentrations of 50% gluconic acid, the ware washed with the cleaning systems resulted in frosted glasses and spotted plastic after only 25 cycles in the Hobart Dish Machine AM15.

Table 8 also illustrates that a rinse solution including 9% gluconic acid at 1 mL/rinse and 3 mL/rinse concentrations did not prevent calcium precipitation onto the surfaces of the glasses and plastic tumbler. The glasses were very frosted and the plastic tumbler was spotted after only 25 cycles in the Hobart Dish Machine AM15.

Example 5

Caustic Detergent+Various Concentrations of Gluconic Acid Rinse Solutions

A caustic detergent composition was formulated with component concentrations of sodium hydroxide, sodium aluminate, lithium hydroxide and a surfactant as listed in Table 9.

TABLE 9

| Component | Weight (g) |
|---|---|
| NaOH (50%) liquid | 550.00 |
| NaOH, beads | 550.00 |
| Sodium Aluminate | 5.3 |
| Lithium Hydroxide | 11.00 |
| Pluronic N3 | 3.00 |

The cleaning systems used the caustic detergent listed in Table 9 and rinse solutions including 50% gluconic acid at about 2 mL/rinse and about 3.6 mL/rinse concentrations. Table 10 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 10

| Rinse Solution | Detergent Conc. (ppm) | NaOH Conc. (ppm) | Cycles | Water Hardness (GPG) | Machine | Appearance |
|---|---|---|---|---|---|---|
| 50% Gluconic Acid: 2 mL/rinse | 458.5 | 338 | 27 | 17 | AM14 | Glasses scaled |
| 50% Gluconic Acid: 3.6 mL/rinse | 458.5 | 338 | 25 | 17 | AM14 | Glasses scaled |

As can be seen in Table 10, even when the concentration of 50% gluconic acid in the rinse solution was increased to 2 mL/rinse and 3.6 mL/rinse, the glasses still had scale on the surfaces after 27 and 25 cycles, respectively, of washing and rinsing in the Hobart Dish Machine AM14.

Example 6

Removal of Starch

5% Rice Flour Soil

To test the ability of a caustic detergent of the present invention to remove starch from the surfaces of ware, a caustic detergent composition was formulated with component concentrations of sodium hydroxide, sodium aluminate, lithium hydroxide and a surfactant as listed in Table 11.

TABLE 11

| Component | Weight (g) |
|---|---|
| NaOH (50%) liquid | 47.98 |
| NaOH, beads | 47.98 |
| Sodium Aluminate | 0.46 |
| Lithium Hydroxide | 0.96 |
| Pluronic N3 | 2.62 |

The caustic detergent composition was tested without a rinse solution and with a rinse solution including 9.85 mL of 50% gluconic acid. Table 12 provides the rinse solution, the concentrations of the rinse solution, detergent and sodium hydroxide, the number of wash cycles, the water hardness, the machine in which the runs were carried out, the appearance of the glasses and plastic tumbler after being washed with the cleaning systems and the amount of redeposition on the glasses and plastic. The glasses and plastic tumbler were covered with a 5% rice flour soil prior to washing and rinsing to test whether the caustic detergent composition could remove the starch.

TABLE 12

| Rinse Solution | Detergent Conc. (ppm) | NaOH Conc. (ppm) | Cycles | Water Hardness (GPG) | Machine | Appearance | Redeposition |
|---|---|---|---|---|---|---|---|
| 17 GPG Water | 458.5 | 330 | 10 | 5 | AM15 | Rice flour residue on the outside/None on Plastic | Small amount of redeposition |
| 50% Gluconic Acid: 9.85 mL | 458.5 | 330 | 10 | 5 | AM15 | Clear | Clear |

As can be seen by the data in Table 12, when hard water was used to rinse the glasses and plastic tumbler, there was a small amount of redeposition on the ware. By contrast, when 9.85 mL of 50% gluconic acid was added to the rinse solution, there was no calcium precipitation or redeposition onto the surfaces of the glasses or plastic tumbler.

Example 7

Removal of Fats, Protein and Starch

To test the ability of a cleaning system including a highly caustic detergent and a rinse solution with gluconic acid to remove protein from glass and plastic surfaces according to the Multi-Cycle Spot, Film and Soil Removal method described above, a caustic detergent composition was first formulated with component concentrations of sodium hydroxide, sodium aluminate, lithium hydroxide and a surfactant as listed in Table 13.

TABLE 13

| Component | Weight (g) |
|---|---|
| NaOH (50%) liquid | 22.00 |
| NaOH, beads | 22.00 |
| Sodium Aluminate | 0.21 |
| Lithium Hydroxide | 0.44 |
| Pluronic N3 | 1.20 |

To test that the caustic detergent provided in Table 13 had sufficient ability to remove soil and prevent redeposition of soil onto ware, a plurality of glasses and a plastic tumbler were soiled with Cream of Chicken Soup prior to cleaning with the caustic detergent and a rinse solution including 50% gluconic acid at a concentration of 1 mL/rinse. The Cream of Chicken Soup was used because it contained fat, protein and starch, allowing the removal of all three to be tested at one time. The Cream of Chicken Soup was used without dilution to take advantage of the high levels of soil present in the composition.

Table 14 provides the rinse solution, the concentrations of the rinse solution, detergent and sodium hydroxide, the number of wash cycles, the water hardness, the machine in which the runs were carried out, the appearance of the glasses and plastic tumbler after being washed with the cleaning system and the amount of redeposition on the glasses and plastic.

TABLE 14

| Rinse Solution | Detergent Conc. (ppm) | NaOH Conc. (ppm) | Cycles | Water Hardness (GPG) | Machine | Appearance | Redeposition |
|---|---|---|---|---|---|---|---|
| 50% Gluconic Acid: 1 mL/rinse | 458 | 330 | 10 | 5 | AM15 | Soiled glasses/Plastic slightly spotted | Slightly spotted |

Table 14 shows that a 1 mL/rinse solution of 50% gluconic acid at 5 GPG is almost enough to control de deposition of calcium carbonate on the surface of the ware, and only minor spots were present. This indicates a relationship between the acid chelator concentration used and the water hardness of the rinse cycle.

Table 15 provides the results of the Commassie Blue and Sudan IV staining tests. The Commassie Blue and Sudan IV staining tests were first performed on new and unsoiled ware to establish a baseline. The Commassie Blue stain test was then performed on ware washed and rinsed using the caustic detergent of Table 13 and a rinse solution including a 1 mL/rinse concentration of 50% gluconic acid to determine the amount of redeposition soils and protein soils remaining on the ware. The Sudan IV stain test was also performed on ware washed and rinsed using the caustic detergent of Table 13 and the rinse solution including the 50% gluconic acid to determine the amount of fat soils remaining on the ware.

TABLE 15

| Stain | New and Unsoiled Commassie Blue and Sudan IV | Redeposition Commassie Blue | Protein Commassie Blue | Fats Sudan IV | Fats Sudan IV |
|---|---|---|---|---|---|
| Redeposition | Slightly blue | Clear | Slightly blue | Clear | Slightly pink |
| Soiled | Slightly pink | Slightly blue | Slightly blue | Clear | Slightly pink |

As can be seen in Table 15, new and unsoiled glass and plastic surfaces resulted in slightly blue and slightly pink hues when stained with the Commassie Blue and Sudan IV, respectively. Therefore, even without being soiled or washed, the glasses and plastic tumbler adsorbed small amounts of the dyes. The glasses and plastic tumblers washed with the caustic detergent of Table 13 and rinsed with the rinse solution including the 1 mL/rinse concentration of 50% gluconic acid also resulted in slightly blue and slightly pink hues. This indicates that the cleaning systems were successful in preventing calcium precipitation and redeposition.

Example 8

Caustic Detergent+Single Polymer

After determining that using a caustic detergent in combination with an effective amount of chelating acid in a rinse solution could prevent calcium precipitation, various caustic detergents were formulated to include other functional ingredients, such as polymers and chelators. These caustic detergents were then tested to determine whether an ingredient could be added to the formulation that would linger on the surface of the ware long enough during the rinse cycles to prevent deposition of the water hardness onto the surfaces. A first caustic detergent composition was formulated with component concentrations of sodium hydroxide, sodium aluminate, lithium hydroxide, a surfactant and a polymer as listed in Table 16. In particular, the caustic detergent included Acusol 505N, an acrylate-maleic copolymer having a molecular weight of about 40,000 g/mol, available from Dow Chemical Company, Midland, Mich.

TABLE 16

| Component | Weight (g) |
|---|---|
| NaOH (50%) liquid | 22.00 |
| NaOH, beads | 22.00 |
| Sodium Aluminate | 0.21 |
| Lithium Hydroxide | 0.44 |
| Pluronic N3 | 1.20 |
| Acusol 505N (35%) | 2.95 |

The cleaning system used the caustic detergent and hard water as a rinse solution. Table 17 provides the rinse solution, the concentrations of the detergent and sodium hydroxide, the number of wash cycles, the water hardness, the machine in which the runs were carried out and the appearance of the glasses and plastic tumbler after being washed with the cleaning system.

TABLE 17

| Rinse Solution | Detergent Conc. (ppm) | NaOH Conc. (ppm) | Cycles | Water Hardness (GPG) | Machine | Appearance |
|---|---|---|---|---|---|---|
| 17 GPG Water | 488 | 330 | 25 | 17 | AM15 | Center glasses very frosted/ Plastic slightly spotted |

As can be seen in Table 17, the addition of a polymer commonly used in warewashing detergents to the caustic detergent did not prevent the precipitation of calcium.

Example 9

Caustic Detergent+Polymer Combination

Another caustic detergent was then formulated including two different polymers, Acusol 445ND and Acusol 505N, to test if a combination of polymers which works very well with detergent formulas containing similar level of sodium hydroxide and sodium carbonate would give similar results with a formula that is free of carbonate. Component concentrations of sodium hydroxide, sodium aluminate, lithium hydroxide, a surfactant, Acusol 445ND and Acusol 505N in the caustic detergent are as listed in Table 18. Acusol 445ND is a solid acrylate polymer having a molecular weight of about 4,500 g/mol, available from Dow Chemical Company, Midland, Mich.

TABLE 18

| Component | Weight (g) |
|---|---|
| NaOH (50%) liquid | 13.00 |
| NaOH, beads | 26.50 |
| Sodium Aluminate | 0.21 |
| Lithium Hydroxide | 0.44 |
| Pluronic N3 | 1.20 |
| Acusol 445N 45% | 8.90 |
| Acusol 505N 35% | 1.43 |

The cleaning system used the caustic detergent and hard water as a rinse solution. Table 19 provides the rinse solution, the concentrations of the detergent and sodium hydroxide, the number of wash cycles, the water hardness, the machine in which the runs were carried out and the appearance of the glasses and plastic tumbler after being washed with the cleaning system.

TABLE 19

| Rinse Solution | Detergent Conc. (ppm) | NaOH Conc. (ppm) | Cycles | Water Hardness (GPG) | Machine | Appearance |
|---|---|---|---|---|---|---|
| 15 GPG Water | 458.5 | 330 | 100 | 15 | AM15 | Glasses frosted/ Plastic spotted; machine scaled |
| 10.5 GPG Water | 458.5 | 330 | 100 | 10.5 | AM15 | Glasses with some residue/ Plastic slightly spotted; machine slightly scaled |

As can be seen in Table 19, the addition of Acusol 445ND and Acusol 505N, polymers commonly used in warewashing detergents, did not prevent the precipitation of calcium at water hardness levels of 15 of 10.5 GPG.

Example 10

Caustic Detergent+$Na_3$ASDA Chelator

A caustic detergent composition including a chelator was then formulated with component concentrations of sodium hydroxide, sodium aluminate, lithium hydroxide, a surfactant and a chelator as listed in Table 20. In particular, the chelator used was trisodium salt of Aspartic Acid-N,N-diacetate, a common substitute for ethylenediaminetetraacetic acid.

TABLE 20

| Component | Weight (g) |
|---|---|
| NaOH (50%) liquid | 22.00 |
| NaOH, beads | 22.00 |
| Sodium Aluminate | 0.21 |
| Lithium Hydroxide | 0.44 |
| Pluronic N3 | 1.20 |
| 29.32% $Na_3$ASDA | 16.16 |

The cleaning system used the caustic detergent and hard water as a rinse solution. Table 21 provides the rinse solution, the concentrations of the detergent and sodium hydroxide, the number of wash cycles, the water hardness, the machine in which the runs were carried out and the appearance of the glasses and plastic tumbler after being washed with the cleaning system.

TABLE 21

| Rinse Solution | Detergent Conc. (ppm) | NaOH Conc. (ppm) | Cycles | Water Hardness (GPG) | Machine | Appearance |
|---|---|---|---|---|---|---|
| 17 GPG Water | 620 | 330 | 25 | 17 | AM15 | Glasses frosted/ Plastic spotted |

As can be seen in Table 21, the addition of a chelator to the caustic detergent did not prevent the precipitation of calcium.

Example 11

Caustic Detergent+2 mL/Rinse 50% Citric Acid

After determining that at proper concentrations gluconic acid is effective at preventing calcium deposition and redeposition onto the surfaces of glass and plastic, other chelating acids were tested to determine their ability in combination with a caustic detergent to remove protein from glass and plastic and to prevent calcium precipitation according to the methods described above. A caustic detergent composition was formulated with component concentrations of sodium hydroxide, sodium aluminate, lithium hydroxide and a surfactant as listed in Table 22.

TABLE 22

| Component | Weight (g) |
|---|---|
| NaOH (50%) liquid | 47.98 |
| NaOH, beads | 47.98 |
| Sodium Aluminate | 0.46 |

TABLE 22-continued

| Component | Weight (g) |
|---|---|
| Lithium Hydroxide | 0.96 |
| Pluronic N3 | 2.62 |

The caustic detergent composition was tested with a hard water rinse and with a rinse solution including 50% citric acid at a concentration of 2 mL/rinse. Table 23 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 23

| Rinse Solution | Detergent Conc. (ppm) | NaOH Conc. (ppm) | Cycles | Water Hardness (GPG) | Machine | Appearance |
|---|---|---|---|---|---|---|
| 18 GPG Water | 458.5 | 330 | 25 | 18 | AM14 | Center glasses very frosted/ Plastic slightly spotted |
| 50% Citric Acid: 2 mL/ rinse | 458.5 | 330 | 25 | 18 | AM14 | Glasses clear/Plastic slightly spotted |

As can be seen from the results in Table 23, the cleaning system that included the citric acid rinse solution resulted in clear glass and only slightly spotted plastic surfaces while the cleaning system that included a hard water rinse solution resulted in frosted glasses.

To test that the caustic detergent provided in Table 22 had sufficient ability to remove soil and prevent redeposition of soil onto clean glasses, a plurality of glasses and a plastic tumbler were soiled with Cream of Chicken Soup prior to cleaning with the caustic detergent and a rinse solution including a 2 mL/rinse concentration of 50% citric acid. The Cream of Chicken Soup was used because it contained fat, protein and starch, allowing the removal of all three to be tested at one time. The Cream of Chicken Soup was used without dilution to take advantage of the high levels of soil present in the composition.

To evaluate the soil removal, the glasses and plastic tumbler were stained with Commasie Blue and Sudan IV to check for protein and fat deposited on the surface.

Table 24 provides the rinse solution, the concentrations of the rinse solution, detergent and sodium hydroxide, the number of wash cycles, the water hardness, the machine in which the runs were carried out, the appearance of the glasses and plastic tumbler after being washed with the cleaning system, the amount of redeposition on the glasses and plastic tumbler and the results of the Commassie Blue and Sudan IV staining tests.

TABLE 24

| Rinse Solution | Cycles | Water Hardness (GPG) | Machine | Appearance | Redeposition | Commassie Blue | Sudan IV |
|---|---|---|---|---|---|---|---|
| 50% Citric Acid: 2 mL/rinse | 10 | 5 | AM14 | Clear | Clear | Clear | Clear |

As can be seen by the results in Table 24, a cleaning system including the caustic detergent of Table 22 and a rinse solution with a 2 mL/rinse concentration of 50% citric acid was effective at removing protein and fat soils from the surfaces of the glasses and plastic tumbler. Table 24 also illustrates that the cleaning system was effective at preventing redeposition.

Example 12

Caustic Detergent+2 mL/Rinse 50% Citric Acid

A caustic detergent composition was then formulated with component concentrations of sodium hydroxide, sodium aluminate, lithium hydroxide and a surfactant as listed in Table 25.

TABLE 25

| Component | Weight (g) |
|---|---|
| NaOH (50%) liquid | 554.76 |
| NaOH, beads | 556.46 |
| Sodium Aluminate | 5.41 |
| Lithium Hydroxide | 11.24 |
| Pluronic N3 | 3.32 |

The cleaning system used the caustic detergent and a rinse solution including 50% citric acid at a concentration of 2 mL/rinse. Table 26 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 26

| Rinse Solution | Detergent Conc. (ppm) | NaOH Conc. (ppm) | Cycles | Water Hardness (GPG) | Machine | Appearance |
|---|---|---|---|---|---|---|
| 50% Citric Acid: 2 mL/rinse | 458.5 | 338 | 100 | 17.5 | AM14 | Clear; no scale on machine |

Table 26 illustrates that using a rinse solution including 50% citric acid at 2 mL/rinse prevents calcium precipitation onto glass and plastic surfaces.

Example 13

Caustic Detergent+Sodium Citrate/Citric Acid Rinse Solutions

Various cleaning systems having different rinse solutions were then tested for their ability to remove protein from glass and plastic according to the 100-Cycle Film Evaluation method described above. A caustic detergent composition was formulated with component concentrations of sodium hydroxide, sodium aluminate, lithium hydroxide and a surfactant as listed in Table 27.

TABLE 27

| Component | Weight (g) |
|---|---|
| NaOH (50%) liquid | 554.76 |
| NaOH, beads | 556.46 |
| Sodium Aluminate | 5.41 |
| Lithium Hydroxide | 11.24 |
| Pluronic N3 | 3.32 |

The cleaning systems used the caustic detergent and a rinse solution including either sodium citrate or citric acid. A first rinse solution included 40% sodium citrate at a concentration of 4 mL/rinse to see if sodium citrate was effective at preventing calcium precipitation. Two rinse solutions included varying concentrations of 50% citric acid. Table 28 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 28

| Rinse Solution | Detergent Conc. (ppm) | NaOH Conc. (ppm) | Cycles | Water Hardness (GPG) | Machine | Appearance |
|---|---|---|---|---|---|---|
| 40% Sodium Citrate Rinse: 4 mL/rinse | 458.5 | 338 | 100 | 16 | AM15 | Glasses scaled/Plastic spotted; machine scaled |
| 50% Citric Acid: 2 mL/rinse | 458.5 | 338 | 100 | 16 | AM15 | Clear; no scale on machine |
| 50% Citric Acid: 1.24 mL/rinse | 458.5 | 338 | 50 | 15.5 | AM15 | Glasses scaled/Plastic spotted; machine scaled |

Table 28 shows that sodium citrate is not effective in the rinse solution and that a chelating acid must be used. In addition, the concentration of the chelating acid in the rinse solution is significant for preventing the deposition of water hardness onto the surfaces. In particular, a 1.24 mL/rinse concentration of 50% citric acid resulted in scaling and spotting after 50 cycles, while a 2 mL/rinse concentration of 50% citric acid resulted in clear glass and plastic surfaces and no scaling in the dishmachine.

Example 14

Caustic Detergent+NaCitrate Chelator

Next, a caustic detergent was formulated with a chelator to determine whether the citric acid must be present in the rinse solution. A caustic detergent composition was formulated with component concentrations of sodium hydroxide, sodium aluminate, lithium hydroxide, a surfactant and a chelator as listed in Table 29. In particular, the chelator used was hydrated NaCitrate.

TABLE 29

| Component | Weight (g) |
|---|---|
| NaOH (50%) liquid | 10.00 |
| NaOH, beads | 28.00 |
| Sodium Aluminate | 0.21 |
| Lithium Hydroxide | 0.44 |
| Pluronic N3 | 1.20 |
| NaCitrate X 2H2O | 49.00 |

The cleaning system used the caustic detergent listed in Table 29 and a hard water rinse. Table 30 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 30

| Rinse Solution | Detergent Conc. (ppm) | NaOH Conc. (ppm) | Cycles | Water Hardness (GPG) | Machine | Appearance |
|---|---|---|---|---|---|---|
| 10 GPG Water | 888.5 | 330 | 100 | 10 | AM15 | Glasses scaled/Plastic spotted; machine scaled |

The results in Table 30 illustrate that adding a chelator to the caustic detergent composition did not prevent calcium precipitation. Some level of acidity is needed in addition to the acid being a chelator.

Example 15

Caustic Detergent+Various Concentrations of Tartaric Acid Rinse Solutions

Tartaric acid was tested in rinse solutions to determine its ability in combination with a caustic detergent to remove protein from glass and plastic according to the 100-Cycle Film Evaluation method described above. A caustic detergent composition was formulated with component concentrations of sodium hydroxide, sodium aluminate, lithium hydroxide and a surfactant as listed in Table 31.

TABLE 31

| Component | Weight (g) |
|---|---|
| NaOH (50%) liquid | 22.00 |
| NaOH, beads | 22.00 |
| Sodium Aluminate | 0.21 |
| Lithium Hydroxide | 0.44 |
| Pluronic N3 | 1.20 |

The cleaning system used the caustic detergent listed in Table 31 and rinse solutions including either 40% or 50% tartaric acid. Table 32 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 32

| Rinse Solution | Detergent Conc. (ppm) | NaOH Conc. (ppm) | Cycles | Water Hardness (GPG) | Machine | Appearance |
|---|---|---|---|---|---|---|
| 40% Tartaric Acid: 2 mL/rinse | 448.5 | 330 | 100 | 17 | AM14 | Glasses clear after 25 cycles; streaky film on outside of glasses/Plastic slightly spotted; heavy scale build up inside machine |
| 50% Tartaric Acid: 2 mL/rinse | 458.5 | 330 | 100 | 15 | AM15 | Glasses on edge scaled/Plastic slightly spotted; machine slightly scaled |
| 50% Tartaric Acid: 2 mL/rinse | 458.5 | 330 | 100 | 16.5 | AM14 | Slight scale on edges of glasses/Plastic spotted |

As illustrated in Table 32, using a rinse solution including 40% tartaric acid at 2 mL/rinse did not prevent calcium precipitation after 100 cycles. The glasses had a streaky film on the outside surfaces and the plastic tumbler was spotted. In addition, there was heavy scale build up inside the Hobart Dish Machine AM14.

When a rinse solution including 2 mL/rinse concentration of 50% tartaric acid was used, the ware washed and rinsed in the Hobart Dish Machine AM14 resulted in slight scaling on the glasses and spotting on the plastic. When the ware was washed and rinsed using the same rinse solution in the Hobart Dish Machine AM15, and thus at an increased concentration due to the decreased amount of water used in the rinse cycles, the glasses and plastic tumbler were only very slightly scaled and spotted.

Example 16

Caustic Detergent+2 mL/Rinse 6.5% Tartaric Acid

A caustic detergent composition was formulated with component concentrations of sodium hydroxide, sodium aluminate, lithium hydroxide and a surfactant as listed in Table 33.

TABLE 33

| Component | Weight (g) |
|---|---|
| NaOH (50%) liquid | 47.98 |
| NaOH, beads | 47.98 |
| Sodium Aluminate | 0.46 |
| Lithium Hydroxide | 0.96 |
| Pluronic N3 | 2.62 |

The cleaning system used the caustic detergent and a rinse solution including 6.5% tartaric acid at a concentration of 2 mL/rinse. Table 34 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 34

| Rinse Solution | Detergent Conc. (ppm) | NaOH Conc. (ppm) | Cycles | Water Hardness (GPG) | Machine | Appearance |
|---|---|---|---|---|---|---|
| 6.5% Tartaric Acid: 2 gr/rinse | 458.5 | 330 | 25 | 15.5 | AM15 | Glasses frosted/Plastic spotted |

At an acidity of 6.5%, a 2 mL/rinse concentration of tartaric acid was not effective at preventing calcium precipitation.

Example 17

Caustic Detergent+NaTartrate Chelator

Next, a caustic detergent composition was formulated with a chelator to determine whether the tartaric acid must be present in the rinse solution. A caustic detergent composition was formulated with component concentrations of sodium hydroxide, sodium aluminate, lithium hydroxide, a surfactant and a chelator as listed in Table 35. In particular, the chelator used was hydrated NaTartrate.

TABLE 35

| Component | Weight (g) |
|---|---|
| NaOH (50%) liquid | 41.11 |
| NaOH, beads | 41.11 |
| Sodium Aluminate | 0.39 |
| Lithium Hydroxide | 0.82 |
| Pluronic N3 | 2.24 |
| NaTartrate X 2H2O | 14.32 |

The cleaning system used the caustic detergent listed in Table 35 and a hard water rinse. Table 36 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 36

| Rinse Solution | Detergent Conc. (ppm) | NaOH Conc. (ppm) | Cycles | Water Hardness (GPG) | Machine | Appearance |
|---|---|---|---|---|---|---|
| 18 GPG Water | 535 | 330 | 25 | 18 | AM14 | Glasses very frosted/Plastic very spotted |

The results in Table 36 illustrate that adding a chelator to the caustic detergent composition did not prevent calcium precipitation. Some level of acidity is needed in addition to the acid being a chelator.

Example 18

Caustic Detergent+Na Tartrate Chelator+Polymer

A caustic detergent was then formulated with a chelator and a polymer to determine whether the cleaning system would be effective at preventing precipitation. A caustic detergent was formulated with component concentrations of sodium hydroxide, sodium aluminate, lithium hydroxide, a surfactant, a chelator and a polymer as listed in Table 37. In particular, the chelator used was hydrated NaTartrate and the polymer used was Acusol 445 ND.

TABLE 37

| Component | Weight (g) |
|---|---|
| NaOH (50%) liquid | 39.62 |
| NaOH, beads | 39.62 |
| Sodium Aluminate | 0.38 |
| Lithium Hydroxide | 0.79 |
| Pluronic N3 | 2.16 |

TABLE 37-continued

| Component | Weight (g) |
|---|---|
| NaTartrate X 2H2O | 13.80 |
| Acusol 445ND | 3.60 |

The cleaning system used the caustic detergent and hard water as the rinse solution. Table 38 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 38

| Rinse Solution | Detergent Conc. (ppm) | NaOH Conc. (ppm) | Cycles | Water Hardness (GPG) | Machine | Appearance |
|---|---|---|---|---|---|---|
| 17 GPG Water | 555 | 330 | 25 | 17 | AM14 | Glasses have a slight film/ Plastic slightly spotted |
| 17 GPG Water | 555 | 330 | 100 | 17 | AM15 | Glasses frosted/Plastic spotted; machine heavily scaled |

As can be seen from the results in Table 38, adding a chelator and a polymer to the caustic detergent did not prevent calcium precipitation.

Example 19

Caustic Detergent+1 mL/Rinse 28.47% Lactic Acid

Adding lactic acid to the rinse solution was tested to determine its ability in combination with a caustic detergent to remove protein from glass and plastic according to the 100-Cycle Film Evaluation method described above. A caustic detergent composition was formulated with component concentrations of sodium hydroxide, sodium aluminate, lithium hydroxide and a surfactant as listed in Table 39.

TABLE 39

| Component | Weight (g) |
|---|---|
| NaOH (50%) liquid | 47.98 |
| NaOH, beads | 47.98 |
| Sodium Aluminate | 0.46 |
| Lithium Hydroxide | 0.96 |
| Pluronic N3 | 2.62 |

The cleaning system tested used the caustic detergent and a rinse solution including 28.47% lactic acid at a concentration of 1 mL/rinse in both the Hobard Dish Machine AM14 and the Hobart Dish Machine AM15. Table 40 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning systems.

TABLE 40

| Rinse Solution | Detergent Conc. (ppm) | NaOH Conc. (ppm) | Cycles | Water Hardness (GPG) | Machine | Appearance |
|---|---|---|---|---|---|---|
| 28.47% Lactic Acid: 1 mL/rinse | 458.5 | 330 | 25 | 18 | AM14 | Center glasses frosted/Plastic slightly spotted |
| 28.47% Lactic Acid: 1 mL/rinse | 458.5 | 330 | 25 | 18 | AM15 | Center glasses frosted/Plastic slightly spotted |

It is believed that a concentration of 1 mL/rinse of 28.47% lactic acid either did not include enough acidity or chelating power. However, an increase in the concentration of lactic acid in the rinse solution would most likely result in the ability to prevent calcium precipitation onto the ware.

Example 20

Caustic Detergent+2 mL/Rinse 33.2% Maleic Acid

Adding maleic acid into the rinse solution was tested to determine its ability in combination with a caustic detergent to remove protein from glass and plastic according to the 100-Cycle Film Evaluation method described above. A caustic detergent composition was first formulated with component concentrations of sodium hydroxide, sodium aluminate, lithium hydroxide and a surfactant as listed in Table 41.

TABLE 41

| Component | Weight (g) |
|---|---|
| NaOH (50%) liquid | 22.00 |
| NaOH, beads | 22.00 |
| Sodium Aluminate | 0.21 |
| Lithium Hydroxide | 0.44 |
| Pluronic N3 | 1.20 |

The cleaning systems used the caustic detergent and a rinse solution including a 2 mL/rinse concentration of 33.2% maleic acid. Table 42 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 42

| Rinse Solution | Detergent Conc. (ppm) | NaOH Conc. (ppm) | Cycles | Water Hardness (GPG) | Machine | Appearance |
|---|---|---|---|---|---|---|
| 33.2% Maleic Acid: 2 mL/rinse | 458.5 | 330 | 100 | 10 | AM15 | Center glasses clean, heavy frost on edges/Plastic slightly spotted; machinewith minor scale |

It is believed that the rinsing arms of the dishmachine were not working properly during this test and that the outside glasses were not getting the expected amount of rinse water. However, the center glasses were clean after 100 cycles using 33.2% maleic acid at a concentration of 2 mL/rinse in the rinse solution. In addition, there was only slight spotting on the plastic tumbler and minor scale in the dishmachine.

Example 21

Caustic Detergent+2 mL/Rinse 25% Maleic Acid

A caustic detergent composition was formulated with component concentrations of sodium hydroxide, sodium aluminate, lithium hydroxide and a surfactant as listed in Table 43.

TABLE 43

| Component | Weight (g) |
|---|---|
| NaOH (50%) liquid | 554.76 |
| NaOH, beads | 556.46 |
| Sodium Aluminate | 5.41 |
| Lithium Hydroxide | 11.24 |
| Pluronic N3 | 3.32 |

The cleaning system used the caustic detergent and a rinse solution including a 2 mL/rinse concentration of 25% maleic acid. Table 44 provides the rinse solution, the concentrations of the rinse solution, detergent and sodium hydroxide, the number of wash cycles, the water hardness, the machine in which the runs were carried out and the appearance of the glasses and plastic tumbler after being washed with the cleaning system.

TABLE 44

| Rinse Solution | Detergent Conc. (ppm) | NaOH Conc. (ppm) | Cycles | Water Hardness (GPG) | Machine | Appearance |
|---|---|---|---|---|---|---|
| 25% Maleic Acid: 2 mL/rinse | 458.5 | 338 | 100 | 16 | AM15 | Glasses scaled/Plastic spotted; machine scaled |

As can be seen in Table 44, using a 25% maleic acid rinse solution at a concentration of 2 mL/rinse resulted in some calcium precipitation when washed and rinsed in the Hobart Dish Machine AM15. It is believed that a concentration of 2 mL/rinse of 25% maleic acid either did not include enough acidity or chelating power.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A system for cleaning ware, the system comprising:

(a) a detergent composition consisting of at least about 80% by weight alkali metal hydroxide, up to about 10% by weight corrosion inhibitor and up to about 10% by weight surfactant, and (b) a rinse solution consisting of water and a chelating acid.

2. The system of claim 1, wherein the chelating acid is citric acid, gluconic acid, tartaric acid, maleic acid, malic acid, glucaric acid, N-mono and diacetate amino acid, lactic acid, picolinic acid, oxalic acid, 3,4-dihydroxybenzoic acid, fumaric acid, glucoheptonic acid, nitrilotriacetic acid, or ethylenediaminetetraacetic acid.

3. The system of claim 1, wherein the chelating acid is citric acid.

4. The system of claim 1, wherein the detergent composition has a pH of between about 10 and about 12.

5. A cleaning system for removing soils from a surface and preventing precipitation of water hardness, the cleaning system comprising:

(a) a caustic detergent consisting of at least about 80% by weight alkali metal hydroxide, up to about 10% by weight corrosion inhibitor and up to about 10% by weight surfactant, and (b) a rinse solution consisting of water and a chelating acid.

6. The cleaning system of claim 5, wherein the chelating acid is citric acid, gluconic acid, tartaric acid, lactic acid, maleic acid, malic acid, glucaric acid, N-mono and diacetate amino acid, picolinic acid, oxalic acid, 3,4-dihydroxybenzoic acid, fumaric acid, glucoheptonic acid, nitrilotriacetic acid, or ethylenediaminetetraacetic acid.

7. The cleaning system composition of claim 6, wherein the chelating acid is citric acid.

8. The cleaning system of claim 5, wherein the phosphorus containing compound is less than about 0.5% by weight of the caustic detergent.

9. The cleaning system of claim 5, wherein the caustic detergent has a pH of between about 10 and about 12.

10. A method of removing soils from a surface and preventing water hardness deposition onto the surface, the method comprising:

(a) contacting the surface with a caustic detergent composition, wherein the caustic detergent composition consists of at least about 80% by weight alkali metal hydroxide, up to about 10% by weight corrosion inhibitor and up to about 10% by weight surfactant, phosphorus and alkali metal carbonate; and (b) subsequently rinsing the surface with a rinse solution consisting of water and a chelating acid.

11. The method of claim 10, wherein the chelating acid is citric acid, gluconic acid, tartaric acid, lactic acid, maleic acid, malic acid, glucaric acid, N-mono and diacetate amino acid picolinic acid, oxalic acid, 3,4-dihydroxybenzoic acid, fumaric acid, glucoheptonic acid, nitrilotriacetic acid, or ethylenediaminetetraacetic acid.

12. The method of claim 10, wherein the phosphorus is less than about 1.0% by weight of the caustic detergent.

13. The method of claim 10, wherein the alkali metal carbonate is less than about 1% by weight of the caustic detergent.

* * * * *